US009522458B2

(12) United States Patent
Chen

(10) Patent No.: US 9,522,458 B2
(45) Date of Patent: Dec. 20, 2016

(54) CLAMPING STRUCTURE FOR OPEN END WRENCH

(71) Applicant: Tzu-Chun Chen, Taichung (TW)

(72) Inventor: Tzu-Chun Chen, Taichung (TW)

(73) Assignee: YUNG FONG TOOLS CO., LTD., Taichung (TW)

( * ) Notice: Subject to any disclaimer, the term of this patent is extended or adjusted under 35 U.S.C. 154(b) by 119 days.

(21) Appl. No.: 14/501,063

(22) Filed: Sep. 30, 2014

(65) Prior Publication Data

US 2016/0089769 A1 Mar. 31, 2016

(51) Int. Cl.
*B25B 13/08* (2006.01)
*B25B 13/46* (2006.01)

(52) U.S. Cl.
CPC ..... *B25B 13/08* (2013.01); *B25B 13/46* (2013.01)

(58) Field of Classification Search
CPC ..... B25B 13/08; B25B 13/46; B25B 13/5058; B25B 13/58; B25B 13/505; B25B 7/02; B25B 7/22
USPC ..... 81/186
See application file for complete search history.

(56) References Cited

U.S. PATENT DOCUMENTS 574,622 A * 1/1897 Olden ..... B25B 13/08 81/119
2,652,735 A * 9/1953 Wilder ..... B25B 13/08 81/119
3,059,513 A * 10/1962 Ness ..... B25B 13/08 81/119
3,079,820 A * 3/1963 Vantchoura ..... B25B 13/08 81/179
3,620,107 A * 11/1971 Evans ..... B25B 13/46 81/125.1
3,858,467 A * 1/1975 Evans ..... B25B 13/46 81/119
3,868,873 A * 3/1975 Evans ..... B25B 13/46 81/119
3,881,377 A * 5/1975 Evans ..... B25B 13/08 81/119
4,706,528 A * 11/1987 Inoue ..... B25B 13/46 81/129
8,342,064 B2 * 1/2013 Lin ..... B25B 13/08 81/179
8,978,524 B2 * 3/2015 Tuan-Mu ..... B25B 13/08 81/179
2004/0123702 A1 * 7/2004 Wu ..... B25B 13/08 81/170
2010/0083797 A1 * 4/2010 Lee ..... B25B 13/46 81/60

(Continued)

*Primary Examiner* — Hadi Shakeri

(57) ABSTRACT

A clamping structure for an open end wrench contains: a body, and the body including a handle, an operation head, and a clamping portion. The clamping portion has a first jaw arranged on a first side thereof, a second jaw formed on a second side thereof, and a V-shaped retaining fringe defined on a rear end thereof. The first jaw has a first plane defined on a front end thereof, two first recesses arranged on a rear end of the first plane and a first front end of the V-shaped retaining fringe, and an arcuate projection defined between the two first recesses. The second jaw has a second plane defined on a front end thereof, an abutting face arranged between a rear end thereof and a second front end of the V-shaped retaining fringe, and an arcuately concaved section formed between the second plane and the abutting face.

7 Claims, 19 Drawing Sheets

(56) References Cited

U.S. PATENT DOCUMENTS

2011/0259159 A1* 10/2011 Hsieh ..... B25B 13/08
81/125
2012/0297936 A1* 11/2012 Chen ..... B25B 13/08
81/119

* cited by examiner

CLAMPING STRUCTURE FOR OPEN END WRENCH

FIELD OF THE INVENTION

The present invention relates to a clamping structure for an open end wrench which rotates a workpiece in a small operating space easily.

BACKGROUND OF THE INVENTION

A conventional open end wrench is employed to rotate a hex nut and contains a clamping portion, and the clamping portion has two retaining sections defined on two sides thereof to retain two of six sides of the hex nut and to rotate the hex nut.

However, the body is rotated repeatedly between a rotatable starting point and a rotatable stopping point to rotating the hex nut troublesomely.

The present invention has arisen to mitigate and/or obviate the afore-described disadvantages.

SUMMARY OF THE INVENTION

The primary object of the present invention is to provide a clamping structure for an open end wrench which rotates a workpiece in a small operating space easily.

To obtain the above object, a clamping structure for an open end wrench provided by the present invention contains: a body, and the body including a handle, an operation head connecting with a front end of the handle, and a clamping portion defined thereon.

The clamping portion has a first jaw arranged on a first side thereof, a second jaw formed on a second side thereof, and a V-shaped retaining fringe defined on a rear end thereof.

The first jaw has a first plane defined on a front end thereof, two first recesses arranged on a rear end of the first plane and a first front end of the V-shaped retaining fringe, and an arcuate projection defined between the two first recesses.

The second jaw has a second plane defined on a front end thereof, an abutting face arranged between a rear end thereof and a second front end of the V-shaped retaining fringe, and an arcuately concaved section formed between the second plane and the abutting face.

When the arcuate projection is replaced by a flexibly arcuate member and an accommodating portion, an accommodating portion is defined between the two first recesses and has a first through orifice formed on an inner side thereof and a second through orifice vertically defined on an upper surface thereof and communicating with the first through orifice; and the flexibly arcuate member has a column extending outwardly from a rear end thereof, a notch defined in the column, and a resilient element mounted in the notch, such that the flexibly arcuate member is inserted into the first through hole by using the column, and a positioning post is inserted into a rear end of the notch of the column from the second through orifice.

DETAILED DESCRIPTION OF THE PREFERRED EMBODIMENTS

Figure 1:
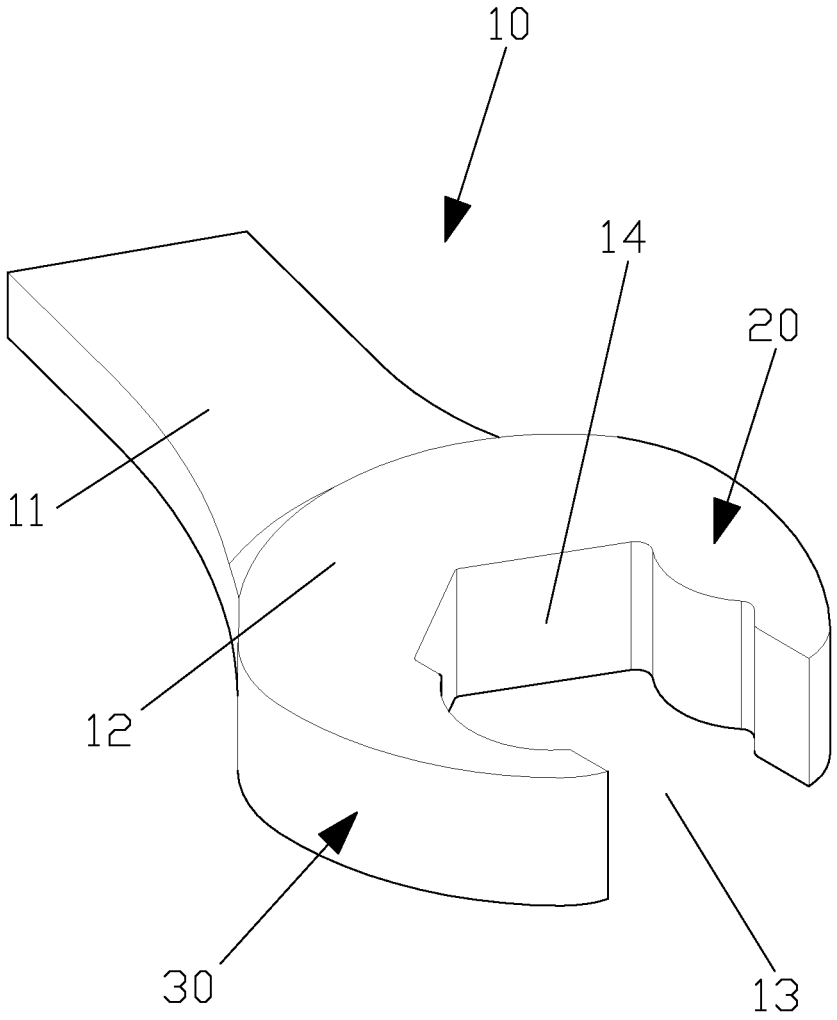
FIG. 1 is a perspective view showing the assembly of a clamping structure for an open end wrench according to a first embodiment of the present invention.
Figure 2:
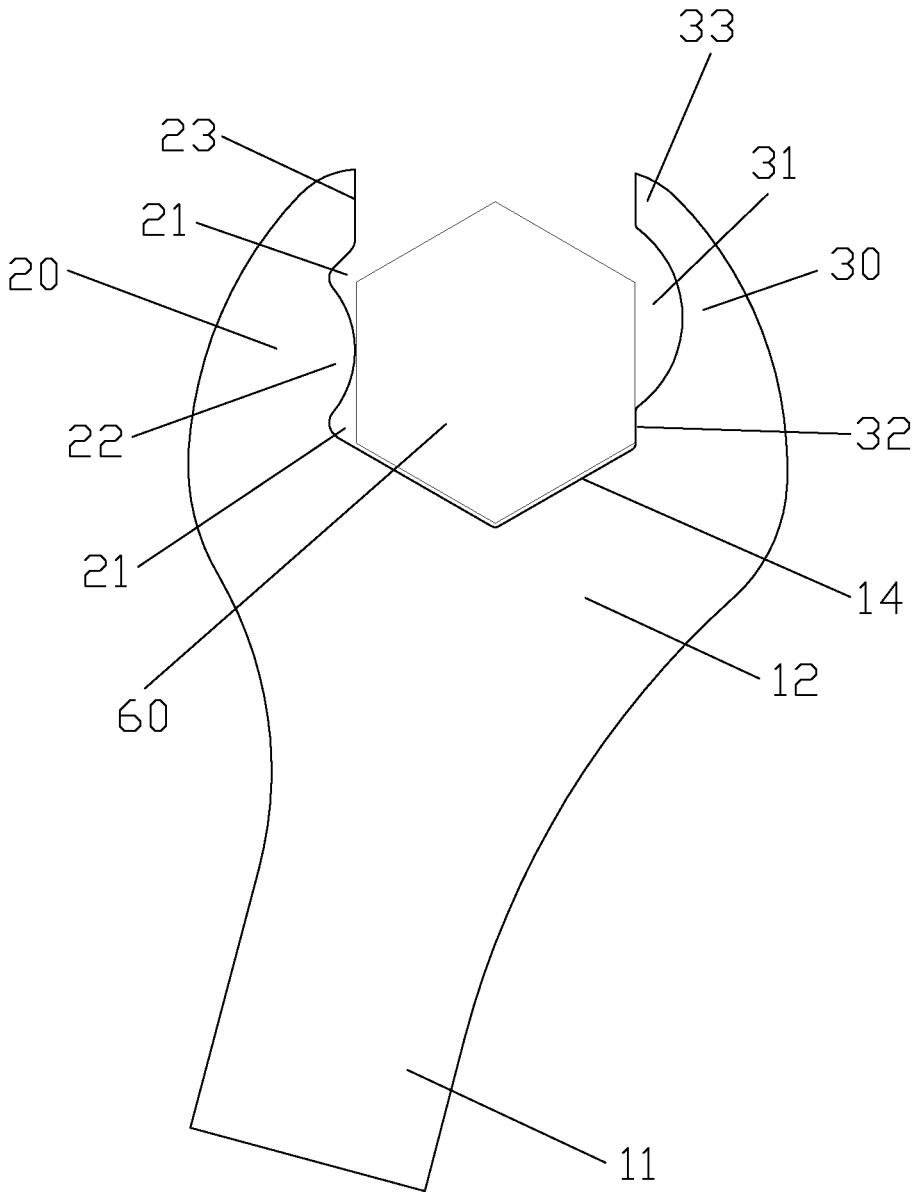
FIG. 2 is a top plane view showing the operations of the clamping structure for the open end wrench according to the first embodiment of the present invention.
Figure 3:
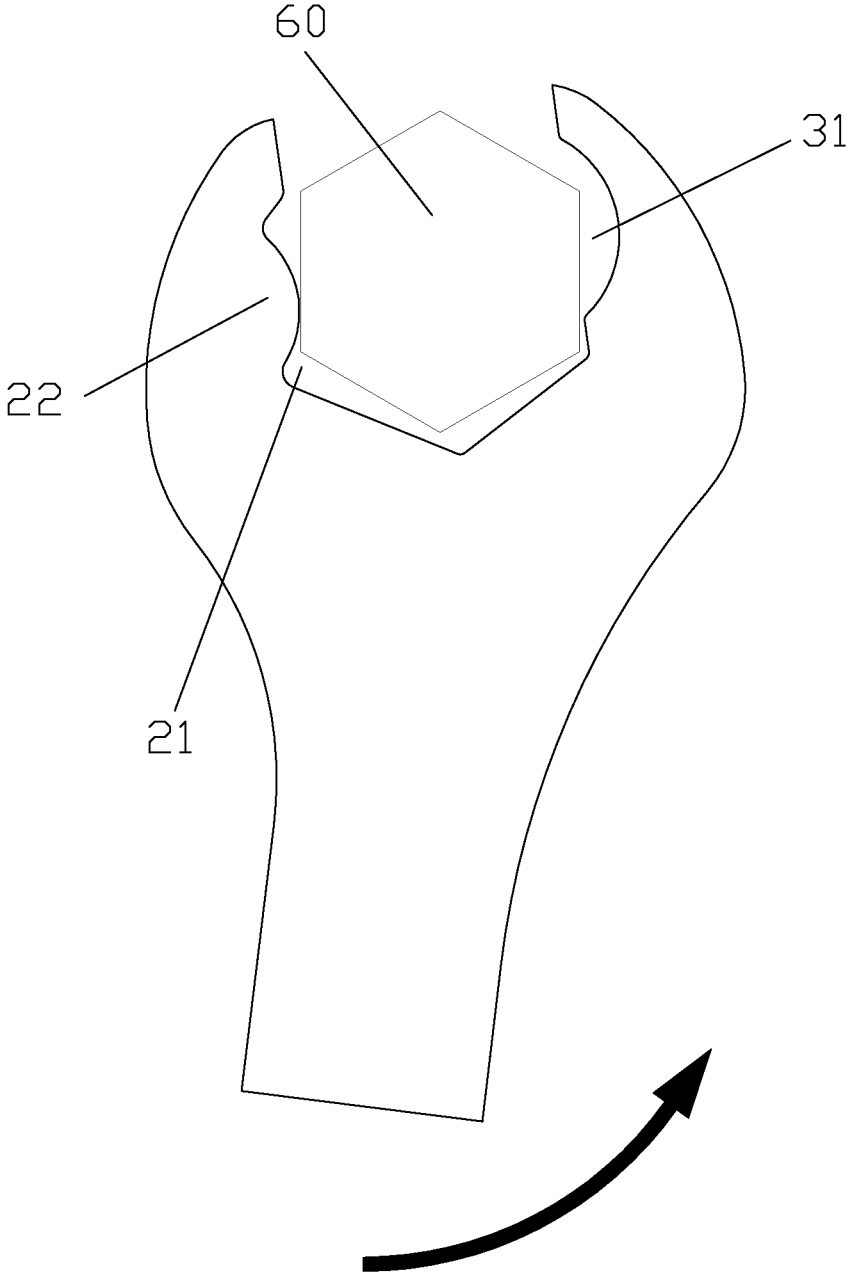
FIG. 3 is another top plane view showing the operations of the clamping structure for the open end wrench according to the first embodiment of the present invention.
Figure 4:
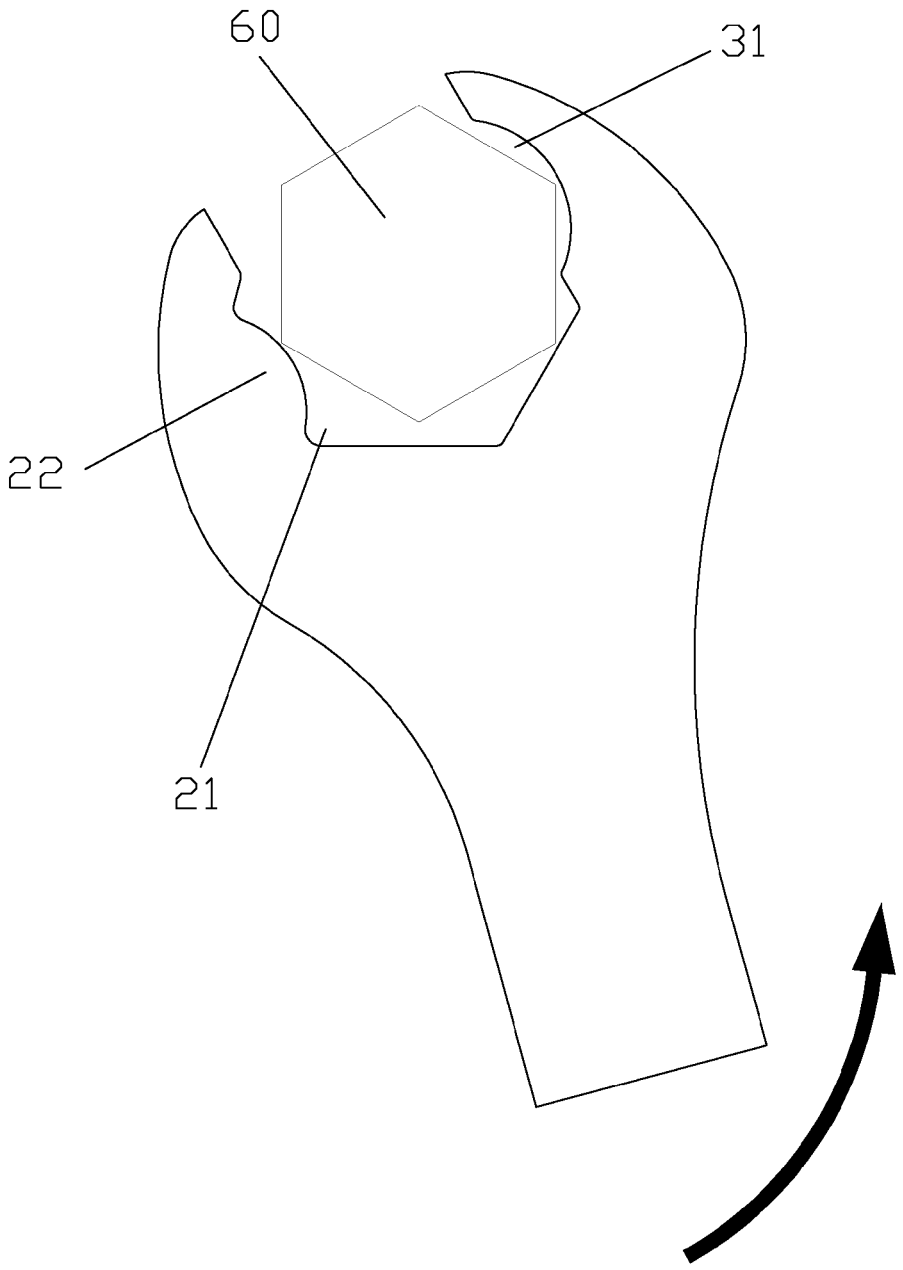
FIG. 4 is also another top plane view showing the operations of the clamping structure for the open end wrench according to the first embodiment of the present invention.
Figure 5:
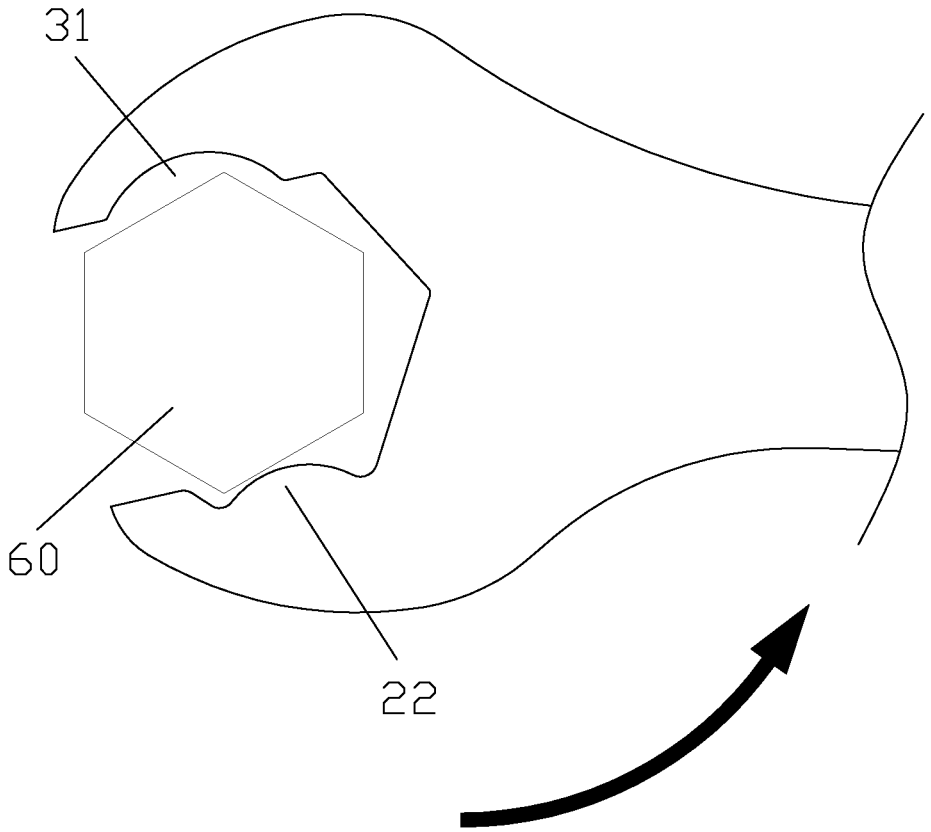
FIG. 5 is still another top plane view showing the operations of the clamping structure for the open end wrench according to the first embodiment of the present invention.
Figure 6:
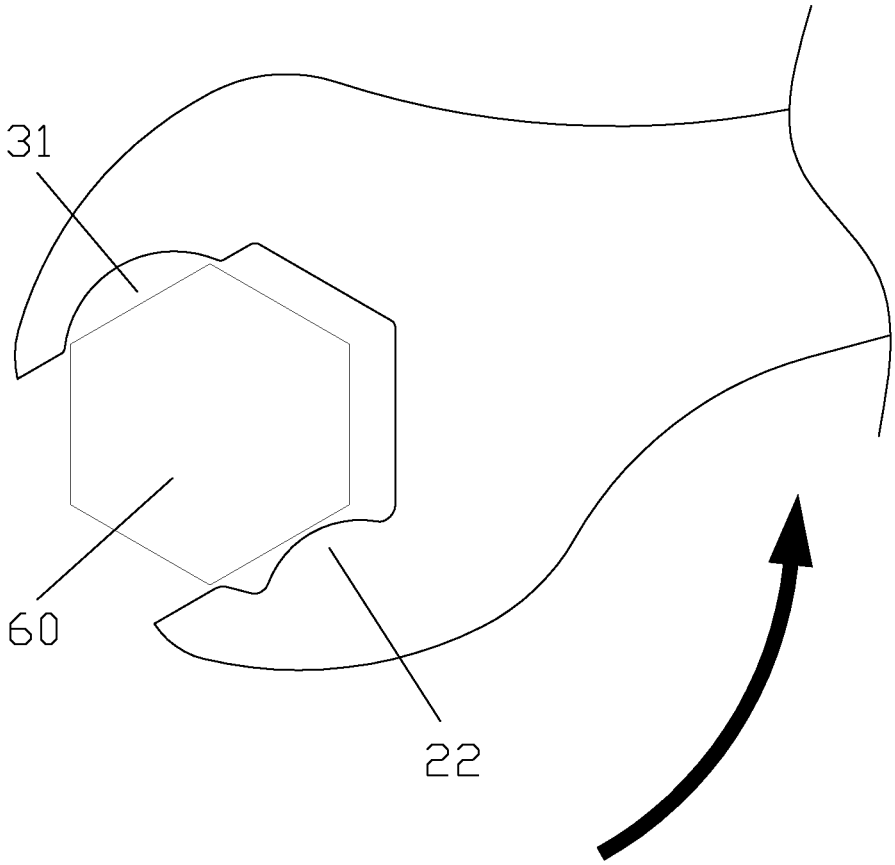
FIG. 6 is another top plane view showing the operations of the clamping structure for the open end wrench according to the first embodiment of the present invention.
Figure 7:
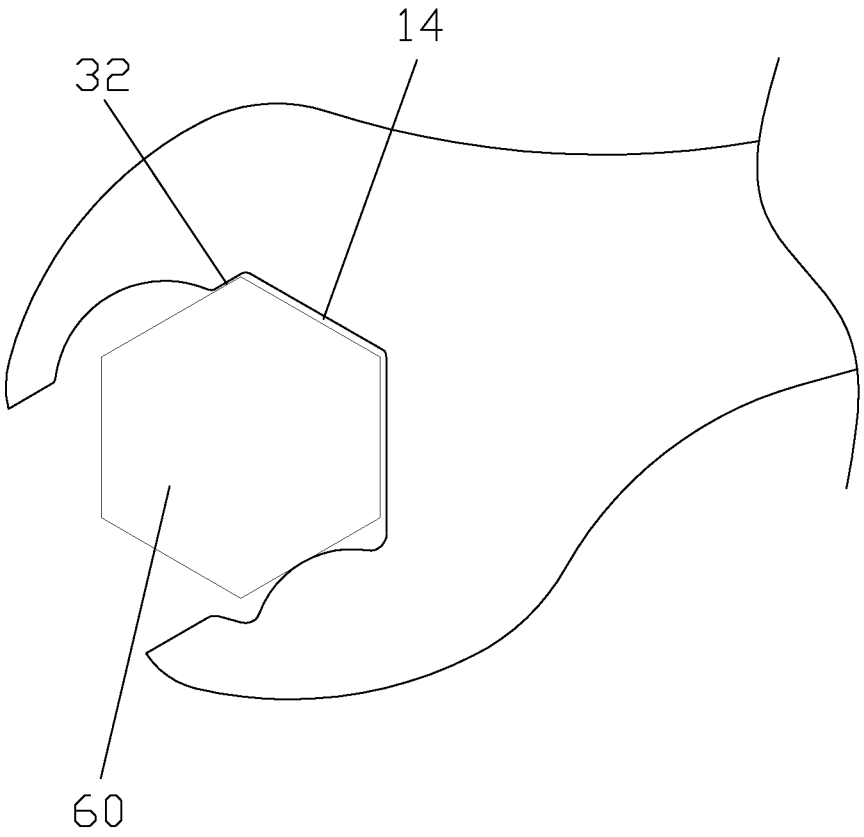
FIG. 7 is another top plane view showing the operations of the clamping structure for the open end wrench according to the first embodiment of the present invention.
Figure 8:
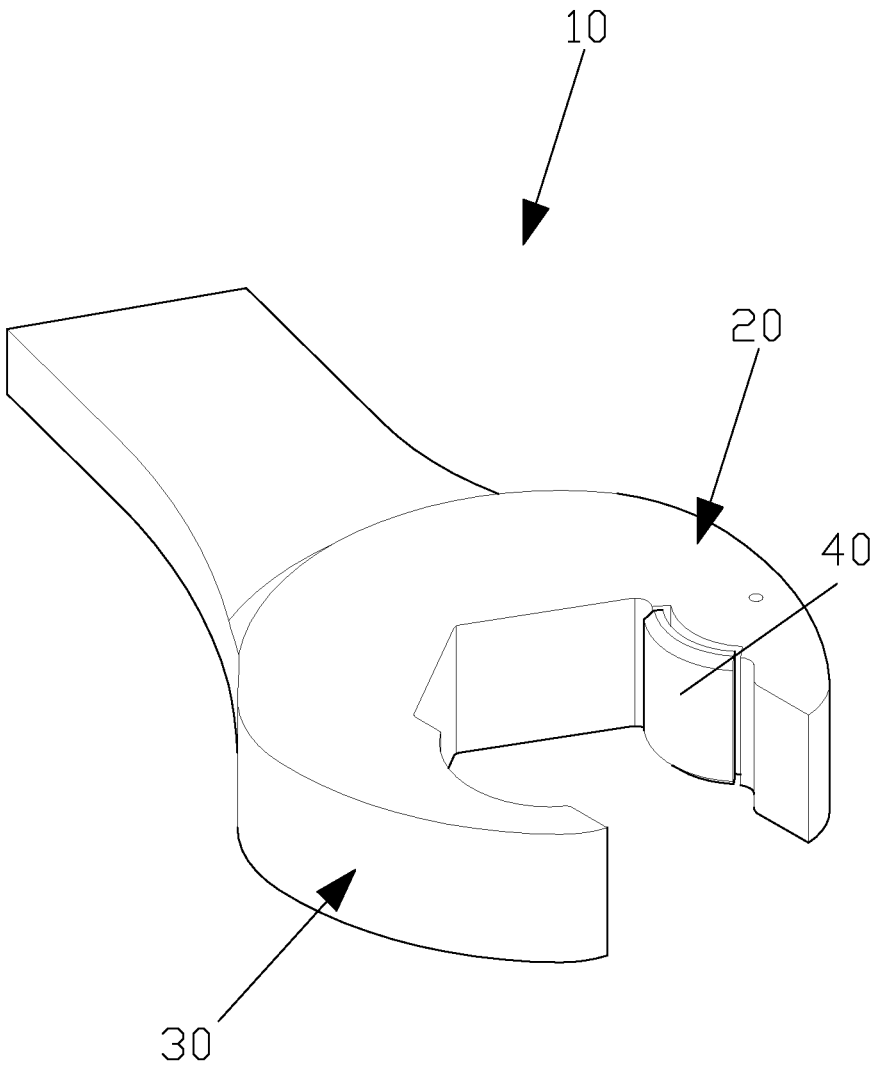
FIG. 8 is a perspective view showing the assembly of a clamping structure for an open end wrench according to a second embodiment of the present invention.
Figure 9:
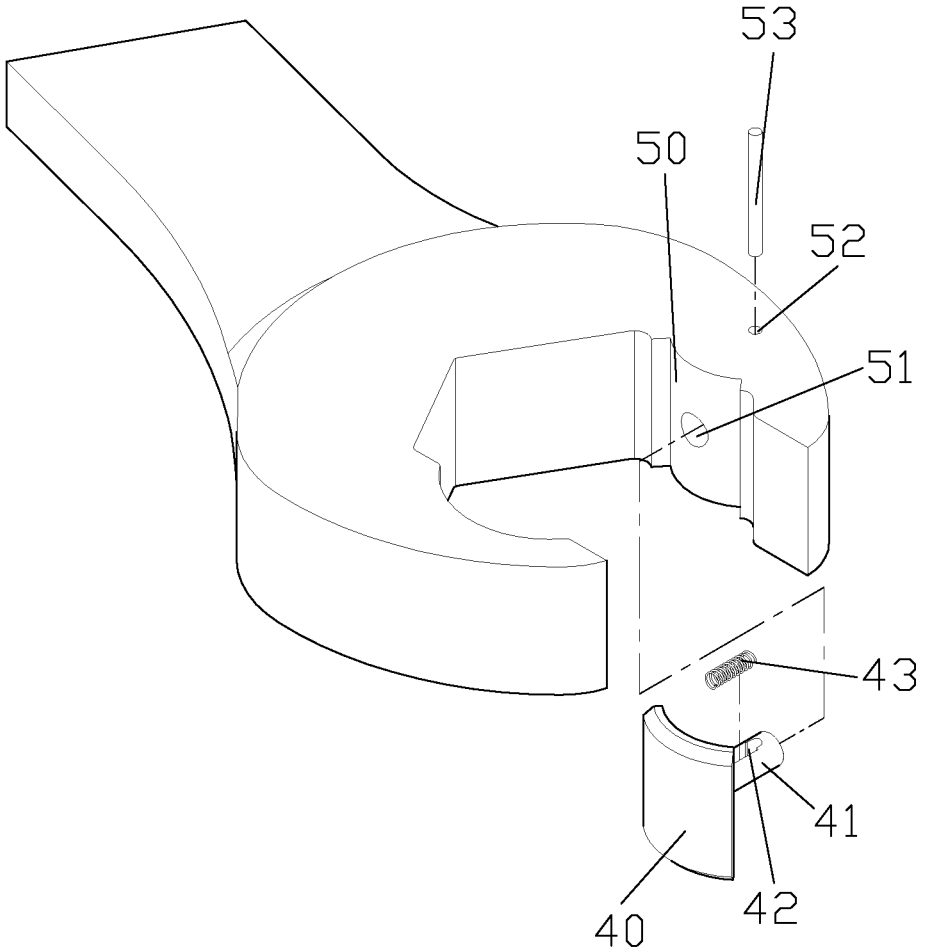
FIG. 9 is a perspective view showing the exploded components of the clamping structure for the open end wrench according to the second embodiment of the present invention.
Figure 10:
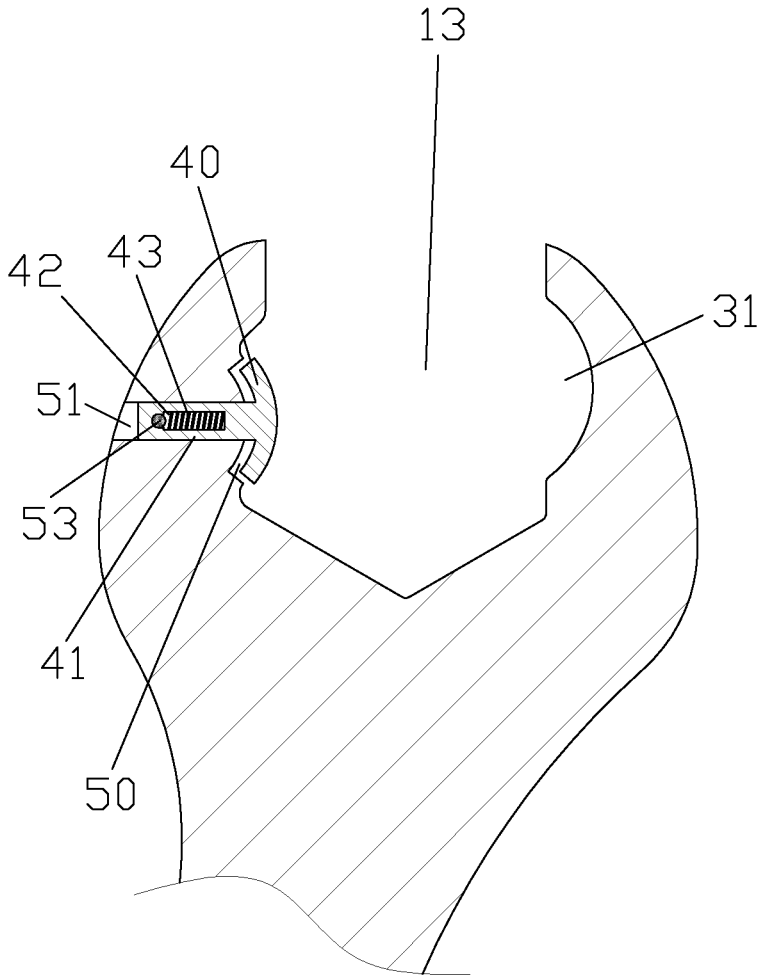
FIG. 10 is a cross sectional view showing the assembly of the clamping structure for the open end wrench according to the second embodiment of the present invention.
Figure 11:
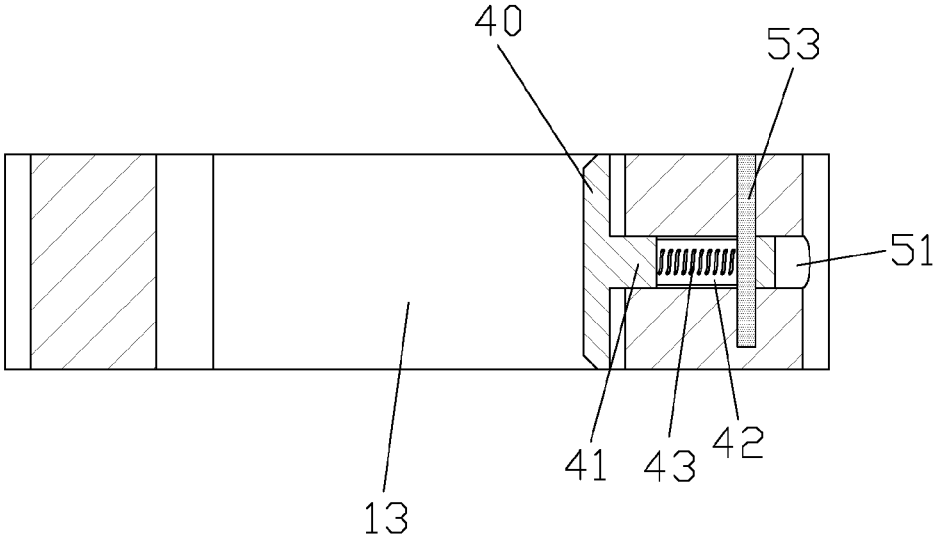
FIG. 11 is a cross sectional view showing the assembly of a part of the clamping structure for the open end wrench according to the second embodiment of the present invention.
Figure 12:
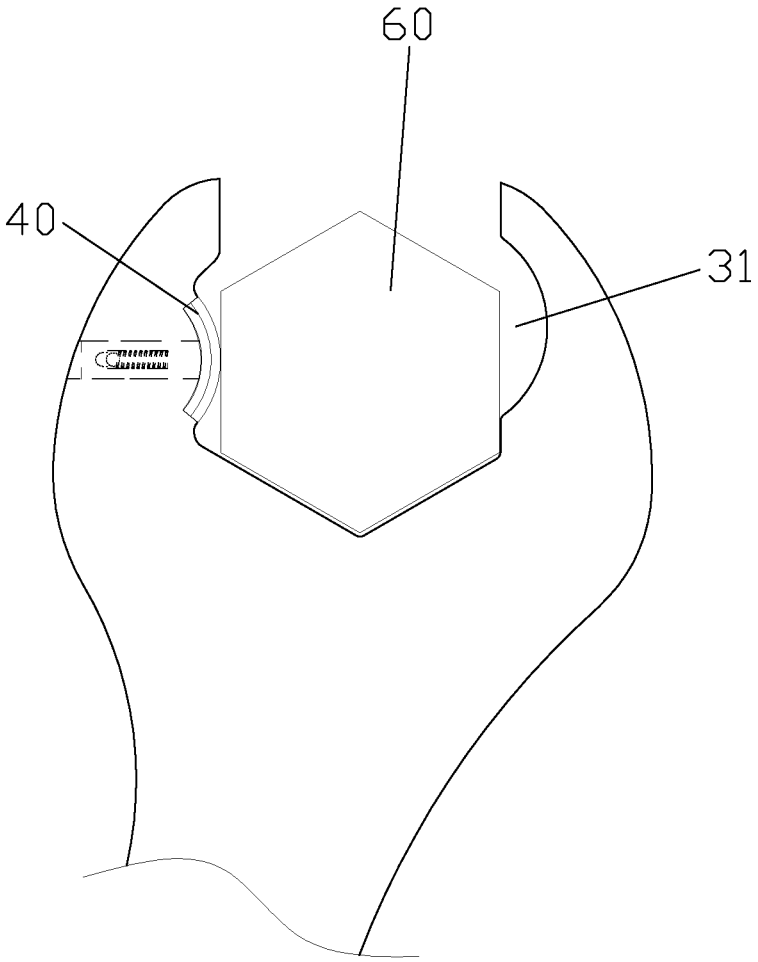
FIG. 12 is a top plane view showing the operations of the clamping structure for the open end wrench according to the second embodiment of the present invention.
Figure 13:
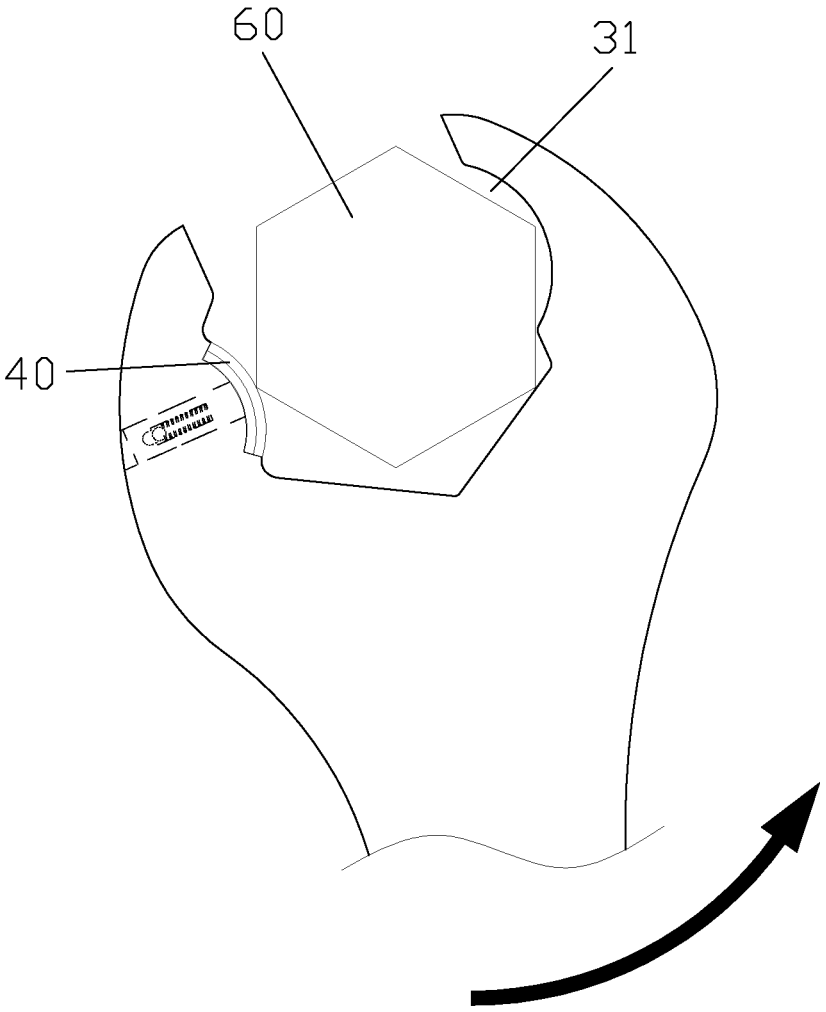
FIG. 13 is another top plane view showing the operations of the clamping structure for the open end wrench according to the second embodiment of the present invention.
Figure 14:
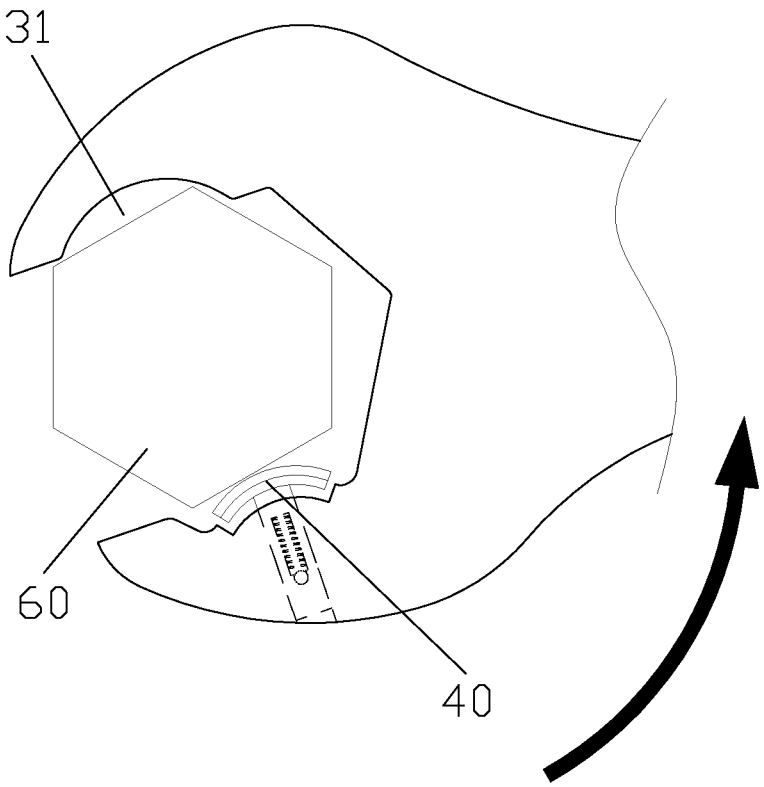
FIG. 14 is also another top plane view showing the operations of the clamping structure for the open end wrench according to the second embodiment of the present invention.
Figure 15:
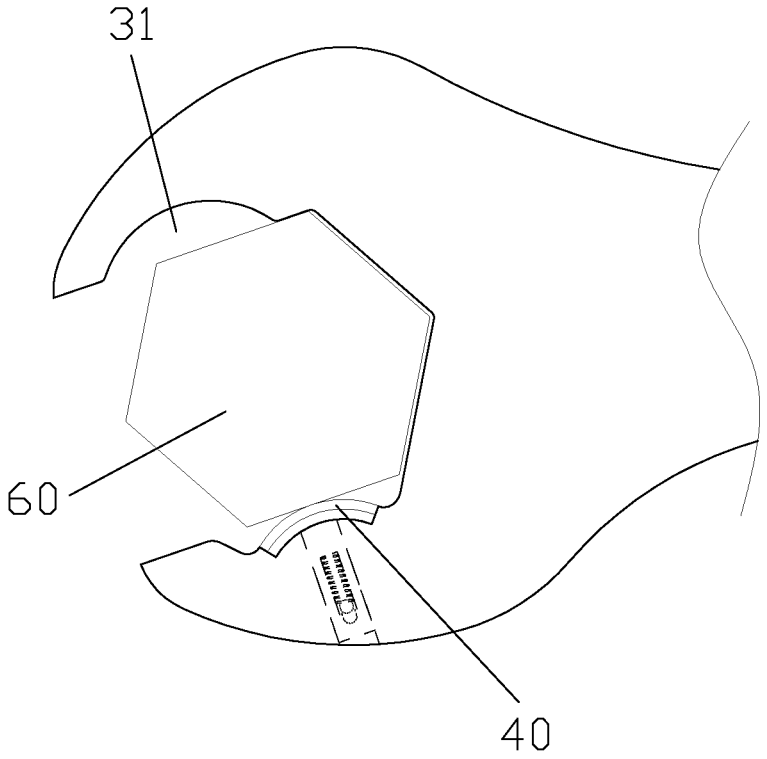
FIG. 15 is still another top plane view showing the operations of the clamping structure for the open end wrench according to the second embodiment of the present invention.
Figure 16:
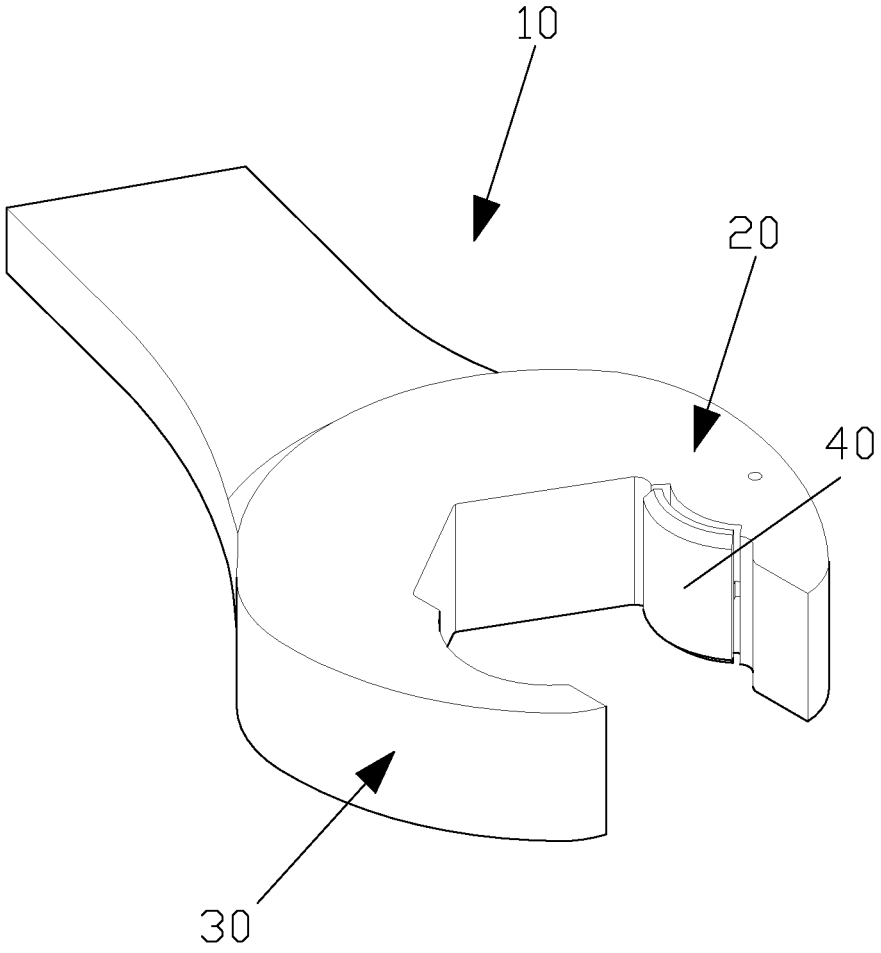
FIG. 16 is a perspective view showing the assembly of a clamping structure for an open end wrench according to a third embodiment of the present invention.
Figure 17:
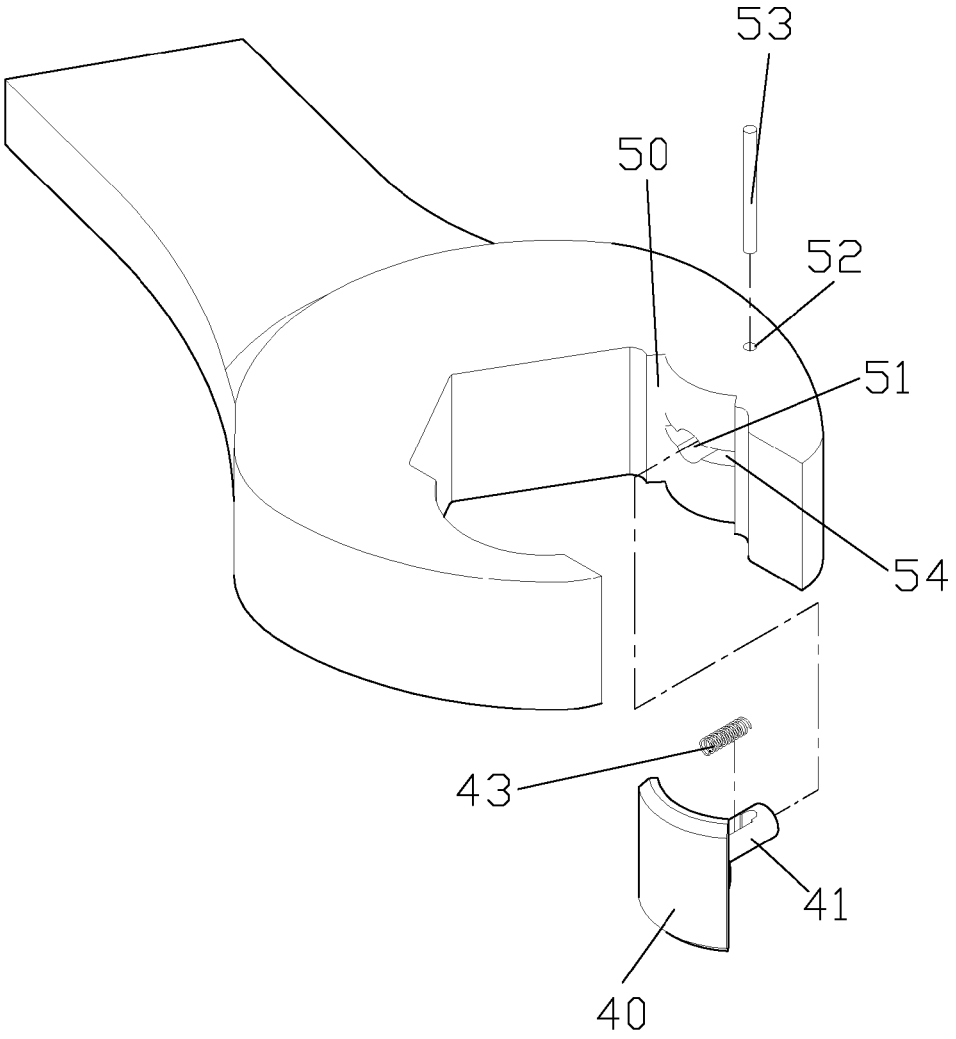
FIG. 17 is a perspective view showing the exploded components of the clamping structure for the open end wrench according to the third embodiment of the present invention.
Figure 18:
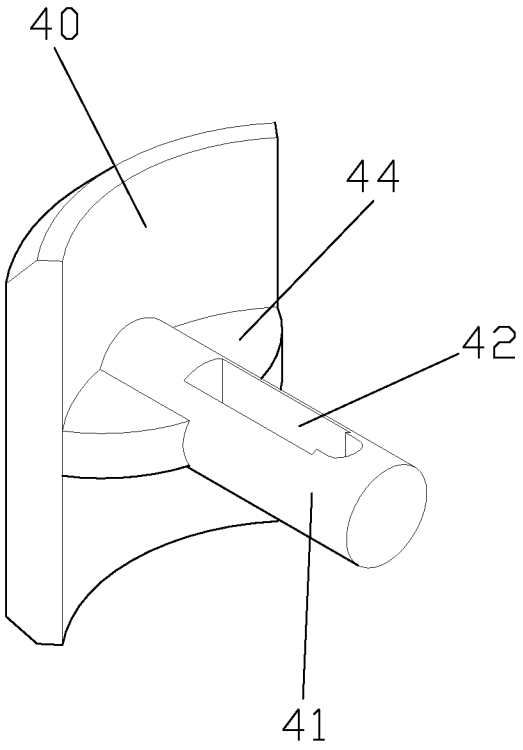
FIG. 18 is a perspective view showing the assembly of a flexibly arcuate member of the clamping structure for the open end wrench according to the third embodiment of the present invention.
Figure 19:
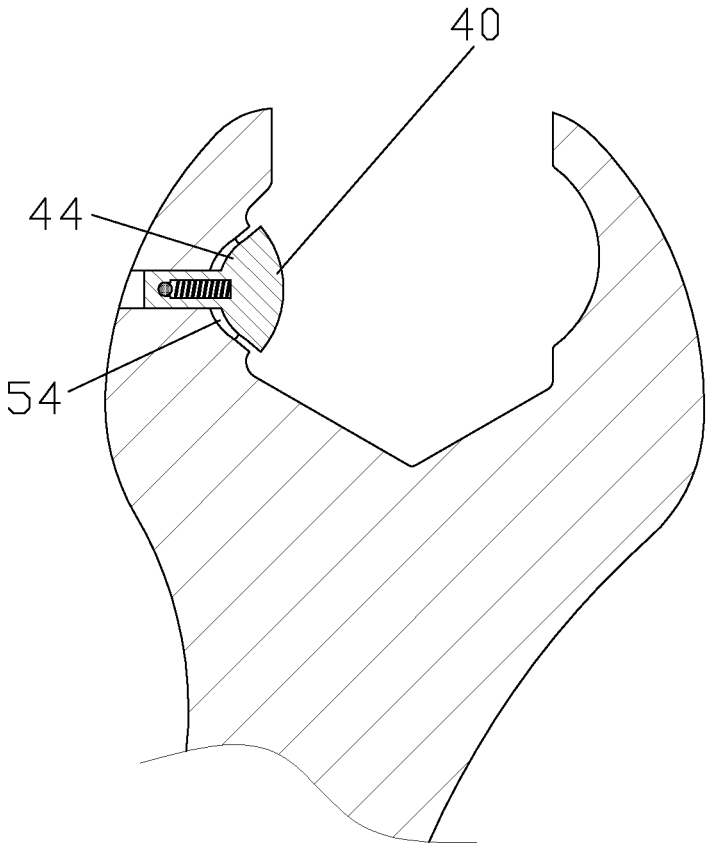
FIG. 19 is a cross sectional view showing the assembly of the clamping structure for an open end wrench according to the third embodiment of the present invention.

Referring to FIGS. 1 and 2, a clamping structure for an open end wrench according to a first embodiment of the present invention comprises: a body 10, and the body 10 includes a handle 11, an operation head 12 connecting with a front end of the handle 11, and a clamping portion 13 defined thereon; wherein the clamping portion 13 has a first jaw 20 arranged on a first side thereof, a second jaw 30 formed on a second side thereof, and a V-shaped retaining fringe 14 defined on a rear end thereof; the first jaw 20 has a first plane 23 defined on a front end thereof, two first recesses 21 arranged on a rear end of the first plane 23 and a first front end of the V-shaped retaining fringe 14, and an arcuate projection 22 defined between the two first recesses 21; the second jaw 30 has a second plane 33 defined on a front end thereof, an abutting face 32 arranged between a rear end thereof and a second front end of the V-shaped retaining fringe 14, and an arcuately concaved section 31 formed between the second plane 33 and the abutting face 32.

With reference to FIGS. 2 to 7, when the clamping portion 13 is rotated, a workpiece 60 is retained by the V-shaped retaining fringe 14 and the abutting face 32, and the workpiece 60 is forced by the abutting face 32 to rotate clockwise toward a maximum desired angle, then the body 10 is rotated counterclockwise so that a first edge of the workpiece 60 enters into one of the two recesses 21 on the first front end of the V-shaped retaining fringe 14, thereafter the arcuately concaved section 31 of the second jaw 30 passes across a second edge of the workpiece 60 opposite to the first edge of the workpiece 60. After keeping rotating the body 10 counterclockwise, the first edge of the workpiece 60 moves to the arcuate projection 22 from the one of the two recesses 21 on the first front end of the V-shaped retaining fringe 14 and finally enters into the other of two recesses 21 on the rear end of the first plane 23, such that the second edge of the workpiece 60 removes from the arcuately concaved section 31, thus idly rotating the body 10. In other words, the workpiece 60 is retained in the clamping portion 13, but the clamping portion 13 is idly rotated by ways of the first jaw 20 and the second jaw 30 to determine a rotatable starting point of the body 10. Thereafter, the workpiece 60 is retained by the V-shaped retaining fringe 14 and the abutting face 32 and is rotated by the abutting face 32, thus rotating the workpiece 60 in a small operating space.

As shown in FIGS. 8 to 12, a difference of a clamping structure for an open end wrench of a second embodiment from that of the first embodiment comprises: a flexibly arcuate member 40 and an accommodating portion 50 for replacing the arcuate projection 22 of the first embodiment; wherein an accommodating portion 50 is defined between the two first recesses 21 and has a first through orifice 51 formed on an inner side thereof and a second through orifice 52 vertically defined on an upper surface thereof and communicating with the first through orifice 51; the flexibly arcuate member 40 has a column 41 extending outwardly from a rear end thereof, a notch 42 defined in the column 41, and a resilient element 43 mounted in the notch 42, such that the flexibly arcuate member 40 is inserted into the first through hole 51 by using the column 41, and a positioning post 53 is inserted into a rear end of the notch 42 of the column 40 from the second through orifice 52. Thereby, when the flexibly arcuate member 40 is pressed to move toward the accommodating portion 50, the column 41 moves backwardly so that the resilient element 42 presses the positioning post 53, and when the flexibly arcuate member 40 removes from the accommodating portion 50, the resilient element 43 pushes the flexibly arcuate member 40 to move toward an original position.

As illustrated in FIGS. 12 to 15, when the workpiece 60 is retained by the V-shaped retaining fringe 14 and the abutting face 32, the flexibly arcuate member 40 is pressed to move backwardly, and when the body 10 is rotated, the flexibly arcuate member 40 retains the workpiece 60 securely.

Referring further to FIGS. 16 to 19, a difference of a clamping structure for an open end wrench of a third embodiment from that of the second embodiment comprises: a limiting groove 54 defined on two sides of the first through orifice 51, and two extensions 44 extending outwardly from two sides of the column 41 of the flexibly arcuate member 40, such that when the flexibly arcuate member 40 is pressed to move backwardly, the two extensions 44 contact with the limiting groove 54, thus fixing the flexibly arcuate member 40 securely.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A clamping structure for an open end wrench comprising: a body, and the body including a handle, an operation head connecting with a front end of the handle, and a clamping portion defined thereon; wherein the clamping portion has a first jaw arranged on a first side thereof, a second jaw formed on a second side thereof, and a V-shaped retaining fringe defined on a rear end thereof;

the first jaw has a first plane defined on a front end thereof, two first recesses arranged on a rear end of the first plane and a first front end of the V-shaped retaining fringe, respectively, and an arcuate projection defined between the two first recesses;

the second jaw has a second plane defined on a front end thereof, an abutting face arranged between a rear end thereof and a second front end of the V-shaped retaining fringe, and an arcuately concaved section formed between the second plane and the abutting face, wherein the second plane is coplanar with the abutting face;

a flexibly arcuate member is disposed on the arcuate projection of the first jaw between the two first recesses, an accommodating portion is defined between the two first recesses and has a first through orifice formed on an inner side thereof and a second through orifice vertically defined on an upper surface thereof and communicating with the first through orifice; and the flexibly arcuate member has a column extending outwardly from a rear end thereof, a notch defined in the column, and a resilient element mounted in the notch, such that the flexibly arcuate member is inserted into the first through hole by using the column, and a positioning post is inserted into a rear end of the notch of the column from the second through orifice.

2. The clamping structure for the open end wrench as claimed in claim 1, wherein when the clamping portion is rotated, a workpiece is retained by the V-shaped retaining fringe and the abutting face.

3. The clamping structure for the open end wrench as claimed in claim 1, wherein when the body is rotated counterclockwise, a first edge of the workpiece enters into one of the two recesses on the first front end of the V-shaped retaining fringe, and the arcuately concaved section of the second jaw passes across a second edge of the workpiece opposite to the first edge of the workpiece; after keeping rotating the body counterclockwise, the first edge of the workpiece moves to the arcuate projection from the one of the two recesses on the first front end of the V-shaped retaining fringe and finally enters into the other of two recesses on the rear end of the first plane.

4. The clamping structure for the open end wrench as claimed in claim 1, wherein the second edge of the workpiece removes from the arcuately concaved section, thus idly rotating the body.

5. The clamping structure for the open end wrench as claimed in claim 1, wherein when the flexibly arcuate member is pressed to move toward the accommodating portion, the column moves backwardly so that the resilient element presses the positioning post, and when the flexibly arcuate member removes from the accommodating portion, the resilient element pushes the flexibly arcuate member to move toward an original position.

6. The clamping structure for the open end wrench as claimed in claim 1, wherein a limiting groove is defined on two sides of the first through orifice, and two extensions extending outwardly from two sides of the column of the flexibly arcuate member.

7. The clamping structure for the open end wrench as claimed in claim 6, wherein, when the flexibly arcuate member is pressed to move backwardly, the two extensions contact with the limiting groove.

* * * * *